United States Patent [19]

Marshall

[11] 4,134,839

[45] Jan. 16, 1979

[54] SOIL RESISTANT SPIN FINISH FOR POLYAMIDE TEXTILE YARN

[75] Inventor: Robert M. Marshall, Chester, Va.

[73] Assignee: Allied Chemical Corporation, Morris Township, Morris County, N.J.

[21] Appl. No.: 874,671

[22] Filed: Feb. 2, 1978

[51] Int. Cl.[2] ..... D06M 13/00

[52] U.S. Cl. ..... 252/8.6; 8/115.6; 252/8.9; 428/375; 560/87

[58] Field of Search ..... 252/8.6, 8.7, 8.75, 252/8.9; 8/115.6 A; 428/375, 394, 395; 560/87

[56] References Cited

U.S. PATENT DOCUMENTS

| | | | |
|---|---|---|---|
| 3,382,097 | 5/1968 | Erby et al. | 428/395 |
| 3,781,202 | 12/1973 | Marshall et al. | 252/8.7 |
| 3,894,992 | 7/1975 | Raynolds | 260/67.6 R |
| 3,959,229 | 5/1976 | Downing et al. | 260/75 H |
| 3,993,571 | 7/1976 | Marshall | 252/8.9 |
| 4,043,923 | 8/1977 | Loudas | 252/8.75 |
| 4,063,024 | 12/1977 | Sandler | 560/87 |

*Primary Examiner*—William E. Schulz
*Attorney, Agent, or Firm*—Fred L. Kelly

[57] ABSTRACT

A soil resistant spin finish particularly for polyamide feeder yarn to be processed at high temperature into bulked textile yarn, comprising a first oil in water emulsion wherein the oil portion consists essentially of sorbitan monooleate, polyoxyethylene tallow amine, and an alkyl stearate, said first oil in water emulsion being mixed with a second oil in water emulsion wherein the oil portion consists essentially of an alkanol amide which is a reaction product of coco fatty acid and diethanol amine, and a fluorochemical compound consisting of a polycarboxybenzene esterified with certain partially fluorinated alcohols and with hydroxyl-containing organic radicals such as glyceryl, 2-hydroxyethyl, chlorohydryl or bromohydryl. Textiles prepared from the bulked yarn show excellent resistance to soiling by oily materials.

10 Claims, No Drawings

SOIL RESISTANT SPIN FINISH FOR POLYAMIDE TEXTILE YARN

CROSS-REFERENCE TO RELATED APPLICATIONS

This application is related to U.S. application Ser. No. 861,372, filed Dec. 16, 1977.

BACKGROUND OF THE INVENTION

This invention relates to a yarn finish. More particularly, this invention relates to a spin finish for polyamide feeder yarn to be processed at high temperature into bulked textile yarn that is oil repellent and resistant to soiling by oily materials.

The treatment of textiles with fluorochemicals to impart oil repellency and soil resistancy has been known for some time. As disclosed in U.S. Pat. Nos. 3,068,187; 3,256,230; 3,256,231; 3,277,039 and 3,503,915, fluorinated polymers have been mixed with non-fluorinated polymers to obtain a treating composition which will impart both water and oil repellency to textiles. U.S. Pat. No. 3,377,197 discloses treating previously cleaned textile fabric with fluorine-containing organometallic compounds to impart resistance against soiling, staining and wetting. U.S. Pat. No. 3,382,097 discloses a treatment for imparting oil and soil repellency to textile fabric, rugs, etc., by treating with a solution of certain fluorinated organic carboxylic acids. This reference also suggests combining a detergent with a fluorochemical acid in an aqueous medium for a one-step cleaning and treating operation. Other representative prior art patents directed to fluorochemical compositions capable of imparting oil repellency to textiles include U.S. Pat. Nos. 3,171,861; 3,514,487; 3,547,861; 3,646,153; 3,870,748; 3,894,992; 3,896,035; 3,896,251; 3,940,359; 3,959,229; and 4,043,923.

The most pertinent prior art is believed to be U.S. application Ser. No. 861,372, filed Dec. 16, 1977, which discloses that polycarboxybenzenes esterified with certain partially fluorinated alcohols and with hydroxyl-containing organic radicals such as 2-hydroxyethyl, glyceryl and chlorohydryl or bromohydryl, when incorporated with polyamide or polyester fibers as by contact in a liquid medium, concentrate at the fiber surface, especially if the fiber is annealed. A relatively durable oil and water repellency is thus imparted to the fiber.

The fluorocarbon modification of fibers in accordance with U.S. application Ser. No. 861,372 is an important contribution to this art. However, I have found that the disclosed oil-repellent fluorocarbon compounds of said application are not compatible with the lubricating oils in spin finishes used in a conventional spinning process. For example, the oil-repellent fluorocarbon compounds will not form a solution with alkyl stearates or coconut oil, which are essential oily components of many spin finishes, including the spin finishes of U.S. Pat. Nos. 3,781,202 and 3,993,571. Moreover, the emulsifying components of said spin finishes are not suitable for preparing an oil in water emulsion containing these oil repellent fluorocarbon compounds. Accordingly, I have carried out extensive research to develop an improved spin finish which has the oil properties of a conventional spin finish and also imparts to the yarn the oil repellent properties of the fluorocarbon finish of U.S. application Ser. No. 861,372.

SUMMARY OF THE INVENTION

It is a primary object of the present invention to provide a spin finish for preparing polyamide feeder yarn to be processed at high temperature into bulked textile yarn, said textile yarn being oil repellent and resistant to soiling by oily materials.

It is another object of the present invention to provide a spin finish for polyamide yarn to be processed into textile yarn by conventional texturing operations involving high temperature.

It is a further object of this invention to provide a spin finish for polyamide yarn, which has excellent stability to high temperature process conditions, provides lubrication, static protection and plasticity to the yarn for subsequent drawing and steam jet texturing and/or producing bulked textile yarn, e.g., bulked carpet yarn.

These and other objects of this invention are provided by a spin finish comprising an oil in water emulsion containing 5 to 20 percent by weight of a first oil composition consisting essentially of about 45 to 55 weight percent of an alkanol amide which is the reaction product of coco fatty acid containing about 6 to 18 carbon atoms and diethanol amine, and about 45 to 55 weight percent of a fluorochemical compound having the formula

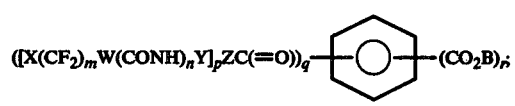

I.

wherein the attachment of the fluorinated radicals and the radicals $CO_2B$ to the nucleus is in asymmetrical positions with respect to rotation about the axis through the center of the nucleus; wherein "X" is fluorine, or perfluoroalkoxy of 1 to 6 carbon atoms, and m has arithmetic mean between 2 and 20; n is zero or unity; "W" and "Y" are alkylene, cycloalkylene or alkyleneoxy radicals of combined chain length from 2 to 20 atoms; $(CF_2)_m$ and "Y" have each at least 2 carbon atoms in the main chain; "Z" is oxygen and p is 1, or "Z" is nitrogen and p is 2; q is an integer of at least 2 but not greater than 5; "B" is $CH_2RCHOH$ or is $CH_2RCHOCH_2RCHOH$ where "R" is hydrogen or methyl, or "B" is $CH_2CH(OH)CH_2Q$ where Q is halogen, hydroxy, or nitrile; or "B" is $CH_2CH(OH)CH_2OCH_2CH(OH)CH_2Q$; and r is an integer of at least 1 but not greater than g; and $X(CF_2)_m$, W and Y are straight chains, branched chains or cyclic; and wherein the substituent chains of the above general formulas are the same or different, said oil in water emulsion being mixed with 5 to 20 percent by weight of said emulsion of a second oil composition consisting essentially of from about 40 to 50 weight percent of an alkyl stearate wherein the alkyl group contains 4 to 18 carbon atoms, about 25 to 30 weight percent sorbitan monooleate, and about 25 to 30 weight percent of polyoxyethylene tallow amine containing about 18 to 22 moles of ethylene oxide per mole of polyoxyethylene tallow amine.

Since very little of this finish flashes off in high temperature processing, about 0.5 to 1.2 percent by weight of yarn, of oil is applied as spin finish, and about 0.5 to 1.2 percent by weight of yarn, of oil remains on the yarn after high temperature processing.

This invention includes also polyamide yarn having incorporated therewith the finish composition as above defined; and process of producing such yarn comprising contacting the yarn with the finish composition as above defined, and thereafter heating the yarn sufficiently to develop oil repellency thereof.

DESCRIPTION OF PREFERRED EMBODIMENT

The preferred fluorochemical compounds which are useful in the spin finish of the present invention are trimellitates and pyromellitates. They can be represented by the following formulas, wherein A and A' represent the same or different radicals $X(CF_2)_mW(CONH)_nY$ of Formula I above, and wherein each A and A' radical has a main chain containing at least six carbon atoms and contains at least four perfluorinated carbon atoms in the radical:

II.

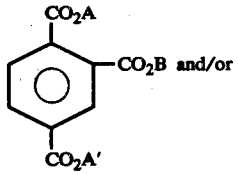

(a) - para

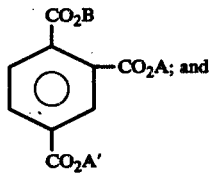

(b) - meta

III.

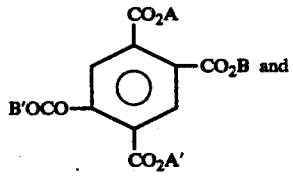

(a) - para

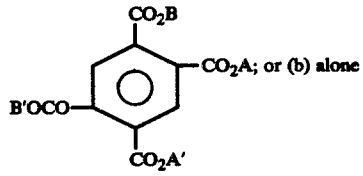

(b) - meta

The above fluorinated radicals A, A' are likewise preferred in the various other compounds of the invention, in particular in bis(diamide)/esters of trimellitic acid and of pyromellitic acid in accordance with this invention.

Fluorochemical compounds which are more particularly preferred are mixtures of substituted pyromellitic acid or trimellitic acid position isomers, especially mixtures of the para and meta pyromellitate position isomers, represented by Formula III (a) and (b) above, with A=A' and B=B' - containing at least six perfluorinated carbon atoms in each radical A, and not over four other chain atoms therein; especially such mixtures containing about 50:50 molar proportions of each of the two-position isomers of Formula III. The attachment of the radicals in the para isomer (see Formula III (a) above) is symmetrical with respect to rotation 180 degrees about the axis through the center of the nucleus. This isomer, used alone, shows relatively low repellency. Nevertheless, when the para isomer is mixed in about 50:50 molar ratio with the meta isomer (which is unsymmetrical with respect to rotation about such axis), the mixture shows repellency essentially equal to the good repellency of the substantially pure meta isomer used alone in the same amount. The corresponding bis-(diamide)/esters of the substituted acids are likewise preferred.

It will be appreciated that although overall the radicals A and A' will both be the same and the radicals B and B' will both be the same in the preferred fluorochemical compounds, they may nevertheless vary within individual molecules because a mixture of fluorinated alcohols will generally be used to obtain the fluorinated radicals A, and because epoxides used to obtain the radicals B may react further to form dimers or higher polymers of the B radicals.

In especially preferred radicals A and A', the fluorinated moiety has the formula $CF_3(CF_2)_m$ or $(CF_3)_2CFO(CF_2)_{m'}$, where m independently at each occurrence has any integral value from 5 to 9, and m' independently at each occurrence has any integral value from 2 to 16, and $(CF_2)_m$ and $(CF_2)_{m'}$ are straight chains.

Preferred radicals B and B' are $CH_2CH_2OH$, $CH_2CH(OH)CH_2Cl$, $CH_2CH(OH)CH_2OH$ and $CH_2CH(OH)CH_2Br$.

A particular feature of the preferred B radicals is that they contain hydroxyl groups, which groups can be utilized for in situ insolubilization of the compound in a fabric, by introducing a polyfunctional epoxide or polyfunctional isocyanate in solution, together with tertiary amine catalyst, and heating to bring about reaction with such hydroxyl groups.

The fluorinated radicals in the fluorochemical compounds useful in this invention are provided in general by reaction between a benzene polycarboylic acid anhydride or carboxy chloride/anhydride, which can be additionally substituted in the benzene ring, and an appropriate fluorinated alcohol or amine. The corresponding carboxylic acid/half ester containing a fluorinated esterifying radical and a carboxy group is produced from the anhydride group reacting with an alcohol; or when the compound is an amide rather than an ester, the appropriate fluorinated amine is used as reactant instead of the alcohol, with production of a fluorinated amido group and a carboxy group. All free carboxy groups can then be esterified by base-catalyzed reaction with the epoxide corresponding to the desired "B" group in the compound.

The invention will now be further described in the following specific examples which are to be regarded solely as illustrative and not as restricting the scope of the invention. In the following examples, parts and percentages employed are by weight unless otherwise indicated.

EXAMPLE 1

The fluorochemical used in this example is a mixture of pyromellitates having the following structure:

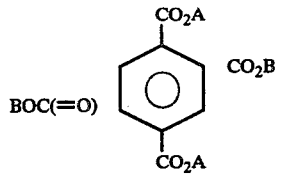

(a) para (50%)

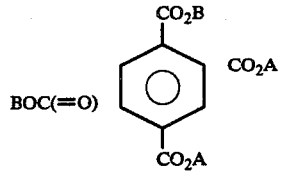

(b) meta (50%)

$A = (CH_2)_2(CF_2)_nCF_3$ where n is 5–13

$B = CH_2CHOHCH_2Cl$

For convenience, this mixture of pyromellitates is hereinafter called Fluorochemical Composition-1. About 50 parts of Fluorochemical Composition-1 is added to 50 parts of an alkanol amide resulting from the reaction of coco fatty acid (containing about 6 to 18 carbon atoms) and diethanol amine, and the mixture is heated at 100° C. until the Fluorochemical Composition-1 melts and forms a clear homogeneous mixture. This oil is then added to 400 parts of water heated to about 93° C. and the mixture is agitated to form an emulsion, which is then cooled to room temperature. The oil particles in this emulsion have a particle size of less than one micron and the emulsion is stable for more than thirty days without signs of separation. For convenience, this emulsion is called Emulsion-1.

Emulsion-1 is then blended with another oil in water emulsion containing 20 percent of an oil composition consisting of 44.5 percent butyl stearate, 27.75 percent sorbitan monooleate, and 27.75 percent of polyoxyethylene tallow amine containing about 20 moles of ethylene per mole of polyoxyethylene tallow amine. The resulting emulsion is stable for at least 30 days and is suitable for use as a spin finish as described hereinafter. For convenience, this emulsion is called Spin Finish-1.

EXAMPLE 2

The procedure of Example 1 is followed except that 50 parts of Fluorochemical Composition-1, 50 parts of the alkanol amide and 800 parts of water are used to form an emulsion, which is called Emulsion-2. The oil particles in this emulsion have a particle size of less than 1 micron and the emulsion is stable for more than 30 days without signs of separation.

Emulsion-2 is then blended with 100 parts of an oil composition consisting of 44.5 percent butyl stearate, 27.75 percent sorbitan monooleate, and 27.75 percent of polyoxyethylene tallow amine containing about 20 moles of ethylene per mole of polyoxyethylene tallow amine. The resulting emulsion is stable for at least 30 days and is suitable for use as a spin finish as described hereinafter. For convenience, this emulsion is called Spin Finish-2. In the preparation of yarn in accordance with the present invention, Spin Finish-2 is equivalent to Spin Finish-1 of Example 1.

EXAMPLE 3

This example demonstrates use of the spin finish of the present invention in a conventional spin-draw process for production of a polyamide yarn suitable for processing into bulked textile yarn that is oil repellent and resistant to soiling by oily materials.

A reactor equipped with a heater and stirrer is charged with a mixture of 1,520 parts of epsilon-caprolactam and 80 parts of aminocaproic acid. The mixture is then flushed with nitrogen and stirred and heated to 255° C. over a one-hour period at atmospheric pressure to produce a polymerization reaction. The heating and stirring is continued at atmospheric pressure under a nitrogen sweep for an additional four hours in order to complete the polymerization. Nitrogen is then admitted to the reactor and a small pressure is maintained while the polycaproamide polymer is extruded from the reactor in the form of a polymer ribbon. The polymer ribbon is subsequently cooled, pelletized, washed and dried. The polymer is a white solid having a relative viscosity of about 50 to 60 as determined at a concentration of 11 grams of polymer in 100 ml. of 90 percent formic acid at 25° C. (ASTM D-789-62T).

The polymer pellets are melted at about 285° C. and melt extruded under pressure of about 1,500 psig. through a 70-orifice spinnerette to produce an undrawn yarn having about 3,600 denier. Spin Finish-2 of Example 2 is applied to the yarn as a spin finish in amount to provide about 1.0 percent by weight of oil on the yarn. The yarn is then drawn at about 3.2 times the extruded length and textured with a steam jet at a temperature of 140° C. to 180° C. to produce a bulked textile yarn that is particularly useful for production of carpets and upholstery fabrics.

The bulked textile yarn is made into a fabric by conventional means and evaluated for oil repellency by AATCC Test No. 118-1975 which involves wetting the fabric by a selected series of liquid hydrocarbons of different surface tensions. The test liquids are as follows:

| Oil Repellency Rating Number | Test Liquid |
|---|---|
| 1 | "Nujol" |
| 2 | 65:35 "Nujol" n-hexadecane by volume |
| 3 | n-Hexadecane |
| 4 | n-Tetradecane |
| 5 | n-Dodecane |
| 6 | n-Decane |
| 7 | n-Octane |
| 8 | n-Heptane |

"Nujol" is the trademark of Plough, Inc. for a mineral oil having a Saybolt viscosity 360/390 at 38° C. and a specific gravity 0.880/0.900 at 15° C.

In the test, one test specimen, approximately 20 × 20 cm., is conditioned for a minimum of four hours at 21± 1° C. and 65± 2 percent relative humidity prior to testing. The test specimen is then placed on a smooth, horizontal surface and, beginning with the lowest numbered test liquid, a small drop — approximately 5 mm. in diameter (0.05 ml. volume) — is placed with a dropping bottle pipette on the test specimen in several locations. The drop is observed for 30 seconds at an angle of approximately 45 degrees.

If no penetration or wetting of the fabric at the liquid-fabric interface and no wicking around the drop occurs, a drop of the next higher-numbered test liquid is placed at a site adjacent on the fabric to the first drop, again observing the drop for 30 seconds. This procedure is continued until one of the test liquids shows obvious wetting of the fabric under or around the drop within 30 seconds.

The fabric made from polyamide yarn prepared in accordance with the present invention has an oil repellency of 6, whereas a control fabric made from yarn prepared with the spin finish of U.S. Pat. No. 3,781,202 has an oil repellency of zero. A second control fabric made from yarn prepared with the spin finish of U.S. Pat. No. 3,993,571 also has an oil repellency of zero.

EXAMPLE 4 (COMPARATIVE)

The procedure of Example 1 is followed except that various emulsifiers were substituted for the alkanol amide of Example 1. The data indicate that the most critical factor in this invention is the emulsifier used to form the emulsion of the fluorochemical composition. The following materials and combinations thereof are used in unsuccessful efforts to emulsify the fluorochemical composition:

EMULSIFIERS

Polyoxyethylene (5-150)[a] castor oil
Polyoxyethylene (16)[a] hydrogenated castor oil
Polyoxyethylene (10)[a] coconut oil
Polyoxyethylene (10-200)[a] corn oil
Sorbitan monooleate
Sorbitan monolaurate
Sorbitan trioleate
Polyoxyethylene (4-20)[a] sorbitan monolaurate
Polyoxyethylene (20)[a] sorbitan monopalmitate
Polyoxyethylene (4-23)[a] lauryl ether
Polyoxyethylene (2-20)[a] oleyl ether
Polyoxyethylene (2-20)[a] stearyl ether
Polyoxyethylene (12)[a] tridecyl ether
Polyoxyethylene (10)[a] tallow amine
Polyoxymethylene (2-15)[a] cocoamine
Polyoxyethylene (2)[a] stearylamine
Bis-2-hydroxyethyl cocoamine
Polyoxyethylene (5-20)[a] monolaurate
Polyoxyethylene (20)[a] dilaurate
Polyoxyethylene (5-20)[a] monooleate
Polyoxyethylene (20)[a] dioleate
Polyoxyethylene (5-20)[a] lauryl ether
Sodium oleate
Potassium fluorinated alkyl carboxylate
Polyoxyethylene (10)[a] octyl phenol
Polyethylene (10)[a] nonyl phenol a = Moles of ethylene oxide per mole of base material.

The following additional emulsifiers give emulsions that are stable for 1–3 days but are not considered suitable for commercial use:

Emulsifiers

Sulfonated succinic acid ester (decyl)
Sulfonated succinic acid ester (octyl)
Sulfonated alkyl naphthalene compound
Fluorinated alkyl quarternary ammonium iodide
Ammonium perfluoroalkyl carboxylate
Fluorinated alkyl polyoxyethylene ethanol

EXAMPLE 5 (COMPARATIVE)

The procedure of Example 2 is followed except that an equal weight of mineral oil (300 S.U.S. viscosity) was substituted for the butyl stearate. The resulting emulsion separates in only three hours.

DISCUSSION

Although the spin finish of the present invention is particularly critical for polyamide yarn to be processed at high temperature into bulked textile yarn that is oil repellent, it also provides many other benefits. The following is a list of additional benefits of the finish composition of this invention:

(1) It has excellent emulsion stability.

(2) An even distribution of the finish on the yarn is readily achieved.

(3) The finish prevents static buildup on the yarn.

(4) Plasticity is imparted to the yarn.

I claim:

1. A spin finish for polyamide yarn to be processed at high temperature into bulked textile yarn that is oil repellent and resistant to soiling by oily materials, said spin finish comprising an oil in water emulsion containing 5 to 20 percent by weight of a first oil composition consisting essentially of about 45 to 55 weight percent of an alkanol amide which is the reaction product of coco fatty acid containing about 6 to 18 carbon atoms and diethanol amine, and about 45 to 55 weight percent of a fluorochemical compound having the formula

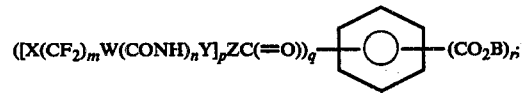

wherein the attachment of the fluorinated radicals and the radicals $CO_2B$ to the nucleus is in asymmetrical positions with respect to rotation about the axis through the center of the nucleus; wherein "X" is fluorine, or perfluoroalkoxy of 1 to 6 carbon atoms, and m has arithmetic mean between 2 and 20; n is zero or unity; "W" and "Y" are alkylene, cycloalkylene or alkyleneoxy radicals of combined chain length from 2 to 20 atoms; $(CF_2)_m$ and "Y" have each at least 2 carbon atoms in the main chain; "Z" is oxygen and p is 1, or "Z" is nitrogen and p is 2; q is an integer of at least 2 but not greater than 5; "B" is $CH_2RCHOH$ or is $CH_2RCHOCH_2RCHOH$ where "R" is hydrogen or methyl, or "B" is $CH_2CH(OH)CH_2Q$ where Q is halogen, hydroxy, or nitrile; or "B" is $CH_2CH(OH)CH_2OCH_2CH(OH)CH_2Q$; and r is an integer of at least 1 but not greater than q; and $X(CF_2)_m$, W and Y are straight chains, branched chains or cyclic; and wherein the substituent chains of the above general formulas are the same or different, said oil in water emulsion being mixed with 5 to 20 percent by weight of said emulsion of a second oil composition consisting essentially of from about 40 to 50 weight percent of an alkyl stearate wherein the alkyl group contains 4 to 18 carbon atoms, about 25 to 30 weight percent sorbitan monooleate, and about 25 to 30 weight percent of polyoxyethylene tallow amine containing about 18 to 22 moles of ethylene oxide per mole of polyoxyethylene tallow amine.

2. The spin finish of claim 1 wherein the fluorochemical compound is a trimellitate, a pyromellitate, or a bis (diamide)/ester of trimellitic acid or of pyromellitic acid, wherein each fluorinated radical, of formula $X(CF_2)_mW(CONH)_nY$, has a main chain containing at least six carbon atoms and contains at least four perfluorinated carbon atoms in the radical.

3. The spin finish of claim 1 wherein the fluorochemical compound is a mixture of pyromellitates having the structure:

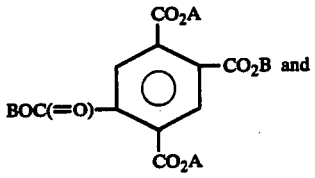

(a) para (50%)

-continued

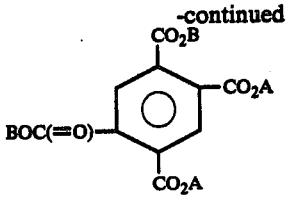

(b) meta (50%)

A = $(CH_2)_2(CF_2)_nCF_3$ where n is 5–13

B = $CH_2CHOHCH_2Cl$

4. The spin finish of claim 1 wherein the alkyl stearate is butyl stearate.

5. The spin finish of claim 1 wherein the polyoxyethylene tallow amine contains about 20 moles of ethylene oxide per mole of said polyoxyethylene tallow amine.

6. A polyamide yarn having incorporated therewith the spin finish of claim 1.

7. A polyamide yarn having incorporated therewith the spin finish of claim 2.

8. A polyamide yarn having incorporated therewith the spin finish of claim 3.

9. A polyamide yarn having incorporated therewith the spin finish of claim 4.

10. A polyamide yarn having incorporated therewith the spin finish of claim 5.

* * * * *